United States Patent [19]

Brand et al.

[11] Patent Number: 4,545,895

[45] Date of Patent: Oct. 8, 1985

[54] FRACTIONAL DISTILLATION

[75] Inventors: Michael J. Brand, Edison, N.J.; Ricardo J. Callejas, Sweeney, Tex.

[73] Assignee: Phillips Petroleum Company, Bartlesville, Okla.

[21] Appl. No.: 584,664

[22] Filed: Feb. 29, 1984

[51] Int. Cl.[4] ..... C10B 3/42

[52] U.S. Cl. ..... 208/351; 196/132; 203/2; 203/78; 208/DIG. 1; 202/160

[58] Field of Search ..... 208/350, 351, 354, 355, 208/358, DIG. 1; 203/2, 78, 84; 202/160, 206; 196/132, 106; 62/42

[56] References Cited

U.S. PATENT DOCUMENTS

| | | | |
|---|---|---|---|
| 2,190,480 | 2/1940 | Nichols, Jr. et al. | 208/351 |
| 2,377,736 | 6/1945 | White | 208/351 |
| 2,500,353 | 3/1950 | Gantt | 208/351 X |
| 2,508,434 | 5/1950 | Storment | 202/206 |
| 2,540,379 | 2/1951 | Ridgway, Jr. et al. | 208/354 |
| 2,645,104 | 7/1953 | Kniel | 62/41 X |
| 2,947,796 | 8/1960 | Warburton et al. | 208/354 |
| 3,313,724 | 4/1967 | Kniel | 208/351 |
| 3,405,530 | 10/1968 | Denahan et al. | 208/351 |
| 3,445,381 | 5/1969 | DeGraff et al. | 208/DIG. 1 |
| 3,448,015 | 6/1969 | Rogers | 203/78 X |
| 3,476,823 | 11/1969 | Price et al. | 203/78 |
| 4,162,188 | 7/1979 | Stockburger et al. | 203/78 X |
| 4,430,102 | 2/1984 | Tedder | 208/351 X |

*Primary Examiner*—D. E. Gantz
*Assistant Examiner*—Glenn A. Caldarola
*Attorney, Agent, or Firm*—S. E. Reiter

[57] ABSTRACT

Process and apparatus are provided for the recovery of low, medium and high boiling components from feed streams containing same wherein reboiler fouling, gumming and the like are minimized, via the control of fractionator reboiler temperatures.

20 Claims, 2 Drawing Figures

FRACTIONAL DISTILLATION

BACKGROUND

1. Field of Invention

This invention relates to the recovery of low, medium and high boiling components from mixtures containing same. In one of its aspects, this invention relates to recovery of ethylene from ethylene containing streams. In another aspect, the invention relates to the recovery of ethylene from the effluent of an ethane cracking unit. In yet another aspect, the invention relates to fractional distillation apparatus.

2. Prior Art

Fractional distillation processes are widely employed for the separation of hydrocarbons of different boiling points. A common problem encountered when it is sought to separate unsaturated hydrocarbons by fractional distillation is the propensity for the contents of the distillation kettle bottoms to foul or form gum as the temperature of the distillation kettle rises. Because of the tendency of the kettle bottom materials to form gum, a spare reboiler kettle is generally kept available to allow for off-stream cleaning of the fouled reboiler kettle. However, off-stream cleaning of the fouled reboiler kettle still requires unit down-time in order to switch the clean reboiler kettle for the fouled reboiler kettle.

OBJECTS OF THE INVENTION

It is therefore an object of this invention to provide a process and apparatus for the frictional distillation of a low, medium and high boiling component containing feed.

It is another object of the present invention to provide a process and apparatus for the fractional distillation of ethylene containing feed wherein the need to replace the deethanizer and/or depropanizer reboiler kettles is greatly reduced or eliminated.

It is yet another object of this invention to provide a process and apparatus for the fractional distillation of ethylene containing feed wherein the temperature of the deethanizer and/or depropanizer reboiler kettles is sufficiently reduced to minimize problems of fouling, polymerization, gumming and the like during distillation.

These and other objects will become apparent upon inspection of the specification and claims.

SUMMARY OF THE INVENTION

In accordance with the present invention, fractional distillation apparatus are provided comprising a deethanizer column, a depropanizer column and a conduit in open communication with the outlet for removal of depropanizer overhead and the inlet for feed to the deethanizer.

In accordance with another embodiment of the present invention, fractional distillation apparatus are provided comprising a depropanizer column, a debutanizer column and a conduit in open communication with the outlet for removal of debutanizer overhead and the inlet for feed to the depropanizer.

In accordance with yet another embodiment of the present invention, a fractionation process is provided comprising:

(a) fractionating a first feed stream comprising low, medium and high boiling components wherein the feed stream contains at least some components which are readily polymerizable at elevated temperatures in a first fractionation column, (b) recovering a first overhead fraction and a first kettle fraction from the first fractionation column, (c) fractionating the first kettle fraction in a second fractionation column, (d) recovering a second overhead fraction and a second kettle fraction from the second fractionation column, and (e) returning at least a portion of the second overhead fraction to the first feed stream.

DESCRIPTION OF THE PREFERRED EMBODIMENTS

Figure 1:
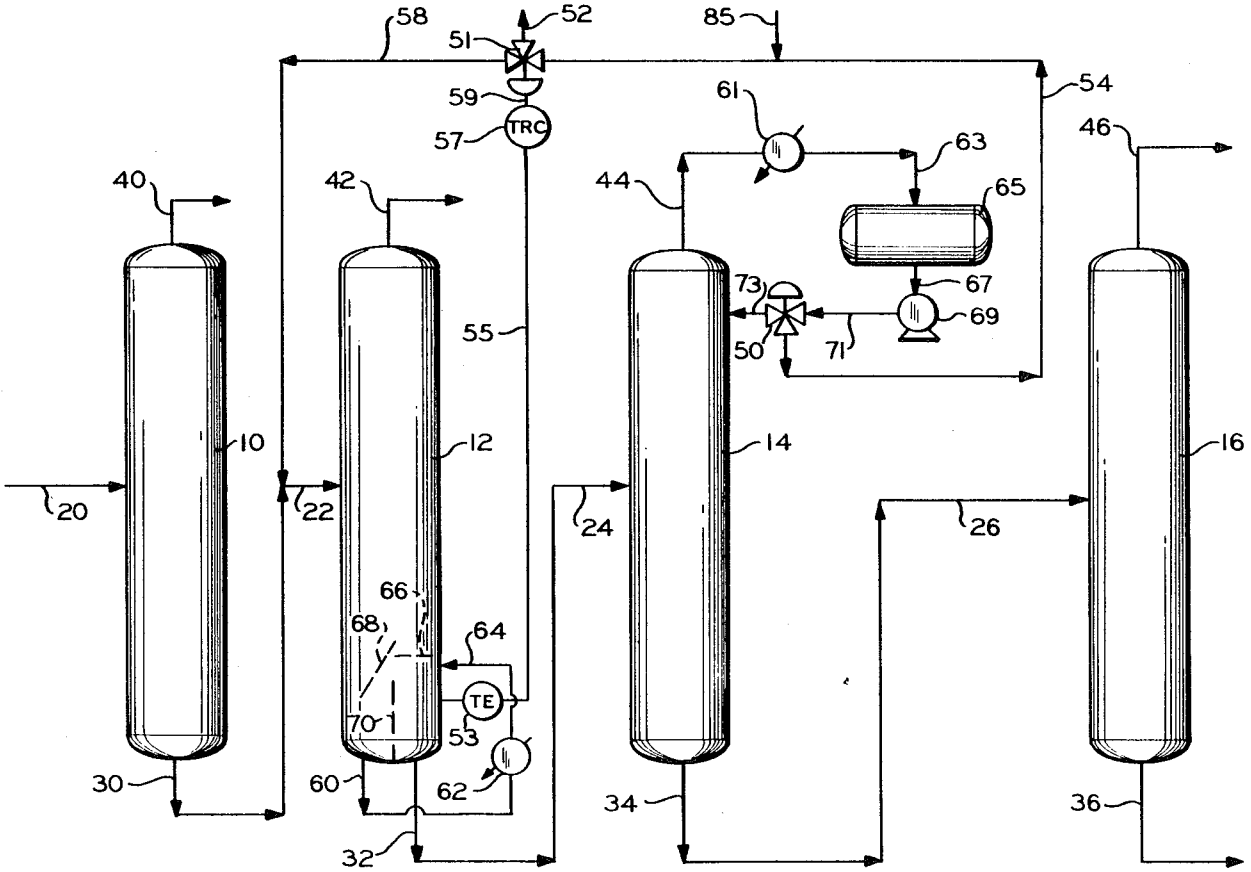
FIG. 1 is a schematic illustration of one embodiment of an apparatus of the invention.

The apparatus and process of the invention are more fully understood by referring to the drawings. Referring first to FIG. 1, suitable feed can be introduced into a first fractionation column, such as for example, demethanizer column 10 via line 20, or alternatively, feed can be introduced directly into the second fractionation column, i.e., into deethanizer column 12 via line 22.

Feed compositions suitable for the practice of this invention are characterized in that the feed composition is prone to gumming or fouling such as by polymerization when subjected to sufficient temperature. In a preferred embodiment, feeds which comprise a major amount of a low boiling component and minor amounts of medium and high boiling components will be employed. Although not intended to limit the scope of the invention, the following concentration ranges, given in weight percent, are provided to guide one skilled in the art in determining whether the inventive process and apparatus could advantageously be applied to a particular separation problem.

| | Concentration Range Wt. % | | |
|---|---|---|---|
| Fraction | Broad | Intermediate | Preferred |
| Low Boiling | ≧50 | ≧70 | ≧90 |
| Medium Boiling | ≦15 | ≦10 | ≦5 |
| High Boiling | ≦35 | ≦20 | ≦5 |

The broad concentration range corresponds to the approximate effluent composition obtained when a heavy feed is subjected to thermal cracking. Heavy feeds are contemplated to include, but are not limited to light, medium and heavy napthas, gas oils and the like. The intermediate concentration range corresponds to the approximate effluent composition obtained when a medium feed is subjected to thermal cracking. Medium feeds are contemplated to include, but are not limited to propane and butane feeds. The preferred concentration range corresponds to the approximate effluent composition obtained when a light feed, such as for example, ethane, is subjected to thermal cracking.

In order to further characterize feeds suitable for the practice of the invention, the following approximate boiling ranges for the low, medium and high boiling fractions are provided. All values are for a pressure of about 415 psig. The operating conditions of the various fractionation columns employed are not limited to the particular values of pressure and temperature provided herein. The following values are provided merely for illustrative purposes.

| Fraction | Boiling Range, °F. (@ 415 psig) Broad | Preferred |
|---|---|---|
| Low Boiling | −100 to +100 | −90 to +50 |
| Medium Boiling | +100 to +200 | +150 to +170 |
| High Boiling | +200 and above | +295 to +400 |

The broad boiling ranges provided are those which are observed when a feed characterized by the broad concentration ranges above are employed. Thus, a low boiling fraction will be recovered over a wider boiling range for a feed having only about 50 wt. % low boiling component than for a feed having significantly higher content of low boiling component (with consequent reduced levels of medium and high boiling components). As the figures in the above table indicate, fractionation of a preferred feed such as for example the effluent of an ethane thermal cracking unit gives more narrowly defined boiling ranges because the low boiling component content of the feed is relatively high and the feed content of the medium and low boiling ranges is relatively low.

A preferred feed for use in the practice of this invention is the effluent of an ethane thermal cracking unit. Thus, the low boiling component of the feed would comprise predominantly C-2 hydrocarbons, i.e., ethane and ethylene as well as lighter components such as methane and hydrogen; the medium boiling component would comprise predominantly C-3 hydrocarbons, i.e., propane and propylene; and the high boiling component would comprise predominantly C-4 and higher hydrocarbons, i.e., butanes, butenes, butadiene, pentanes and the like.

The feed material employed in the practice of the invention can be introduced directly into the fractionation train, or may alternatively be first subjected to any of a variety of pre-treatment steps as are known in the art, such as for example compression, absorption, water removal, acid wash, caustic wash, acetylene removal, hydrogen removal and the like and mixtures of any two or more thereof.

Returning now to FIG. 1, suitable feed, such as for example the effluent of an ethane thermal cracking unit, is introduced into a first fractionation column 10, such as for example a demethanizer. A first overhead fraction is collected via line 40 and a first kettle bottom fraction collected via line 30. The first overhead fraction comprises predominantly materials boiling lower than the desired light fraction. Thus, for example, where the effluent of an ethane thermal cracking unit is employed as feed, the first overhead fraction would comprise predominantly methane. The first kettle bottom fraction is comprised predominantly of low, medium and high boiling components, absent significant quantities of the very low boiling material removed as the first overhead.

At least a portion of the first kettle bottom fraction is passed from line 30 into the second fractionation column 12, such as for example a deethanizer column, via line 22. A second overhead fraction is collected via line 42 and a second kettle bottom fraction collected via line 32. The second overhead fraction comprises predominantly low boiling material while the second kettle bottom fraction is comprised predominantly of medium and high boiling components.

For simplicity, only fractionation column 12 is shown with at least one distillation tray (66), baffle (70) and downcomer (68), although each of columns 10, 12, 14 and 16 can be similarly equipped. In addition, while only column 12 is shown with a reboiler, each of columns 10, 12, 14 and 16 may be similarly equipped. For purposes of illustration, the paths followed by fluid in column 12 will be described in greater detail.

Material which exists in the vapor state at the conditions of column 12 will rise in column 12 upon introduction via line 22, eventually being collected via line 42 as the second overhead. Material which exists in the liquid state at the conditions under which column 12 is operating will fall towards the bottom of the column upon introduction via line 22 along with any descending reflux liquid from the upper section of the fractionation column. Liquid percolates downward through column 12 until it impacts bottom tray 66 (for simplicity, only bottom tray 66 is shown, although column 12, as well as columns 10, 14 and 16 may be equipped with numerous trays). Upon impact with tray 66, liquid may percolate through tray 66 (counter-current to rising vapor) and pass out of column 12 via line 32 or more likely cascade over downcomer 68 and out of column 12 through line 60. Liquid which exits column 12 by this route, i.e. through line 60, is passed through reboiler 62, then returned to column 12 via line 64. Line 64 introduces reboiled fluid into column 12 at a point below the bottom tray 66, such that vapors can percolate upwards through tray 66; while liquid can either descend to the bottom of column 12 and out via line 32, or alternatively, liquid may pass over baffle 70, out exit line 60 and cycle through the reboiler again.

Reboiler 62 can be heated by any suitable means such as for example low pressure steam, high pressure steam, hot oil or the like.

At least a portion of the kettle bottoms from column 12, exiting through line 32 and comprising predominantly medium and high boiling components, is passed from line 32 into the third fractionation column 14, such as for example a depropanizer column, via line 24. A third overhead fraction is collected via line 44 and a third kettle bottom fraction is collected via line 34. The third overhead fraction comprises predominantly medium boiling material, while the third kettle bottom fraction comprises predominantly high boiling material.

For simplicity, only fractionation column 14 is shown with a condenser (61), accumulator (65), reflux and product pump (69) and 3-way valve (50), although each of columns 10, 12, 14 and 16 can be similarly equipped. For purposes of illustration, the paths followed by the third overhead as collected via line 44 will be described in detail.

Vapors collected overhead via line 44 are passed to condenser 61 which can be any condensing means as known in the art such as for example a cooling water condenser, a refrigerated condenser or the like. Condensate from condenser 61 is passed via line 63 to accumulator 65. Condensate is passed from accumulator 65 via line 67 to reflux and product pump 69 which provides condensate to 3-way valve 50 via line 71. Valve 50 can be responsive to any known means for controlling process functions such as for example electrical, mechanical, hydraulic, pneumatic or other similar means of control. Valve 50 controls the flow of condensate back to the column for reflux via line 73 or to product recovery via line 54.

In accordance with the invention, at least a portion of the third overhead fraction condensate which passes through line 54 can be diverted through 3-way valve 51 via line 58 to column 12 inlet 22. That portion of the third overhead fraction condensate which is not returned to column 12 can be directed through valve 51 and collected from line 52. Third overhead fraction material which is collected from line 52 may, if desired, be further processed such as for example to further separate the fraction components, to compress the condensate or the like. Alternatively, the third overhead fraction condensate may be employed directly as recovered for a variety of purposes, such as for example as feedstock for chemical synthesis, polymerization reactions or the like.

The rate and quantity of return of the third overhead fraction condensate to the inlet 22 of the second fractionation column 12 is dependent on a number of variables, such as for example, the content of medium boiling component relative to total feed composition, the pressure (and thus temperature) at which the distillation is carried out, the relative size and fractionation capacity of the several fractionation columns employed, and the like. For example, where the middle boiling component is present at very low levels, say—less than 5 wt. %, then a greater quantity of third overhead fraction recycle is allowed to build up in the reboiler than would be appropriate if the middle boiling component were present in the amount of about 10 wt. %. In general, at least enough of the third overhead fraction will be returned to the second fractionation column to measurably reduce the reboiler vapor temperature. Thus, as further detailed below in the Examples, temperature reductions of 15° F. and larger in the reboiler for the second fractionation column are readily achieved by the practice of the invention. Such large reductions in reboiler temperature minimize the likelihood of fouling, thereby increasing the length of time between the need to clean-out the reboiler kettle.

In a preferred embodiment, the rate of return of the third overhead fraction condensate is controlled by direct communication between temperature element 53 and 3-way valve 51. Valve 51 is adjustable in response to the temperature sensed by the temperature sensing means to maintain a preselected temperature at the bottom of column 12. Thus, a temperature sensor such as for example temperature element 53 establishes a signal representative of the temperature at the bottom of column 12, communicates that signal via line 55 to a control means such as for example temperature recorder/controller 57 which compares the signal from temperature element 53 with a set point signal representative of the desired temperature at the bottom of column 12, and in response to the result of such comparison sends a signal representative of the desired flow rate of third overhead fraction condensate to valve 51. Depending upon whether a higher or lower temperature is desired in the fractionation column, the flow through valve 51 to line 58 will be decreased or increased, respectively. Temperature/recorder controller 57 can be any known means for performing the indicated functions including electrical, mechanical hydraulic, pneumatic, or other similarly operated apparatus adapted to automatically accept the indicated input signals and generate the indicated output signals responsive thereto.

In an alternate embodiment of the invention, an auxiliary stream of medium boiling component, if available, can be introduced into inlet 22 of fractionation column 12 via line 85 to supplement the feed stream comprising low, medium and high boiling components. The rate of introduction of medium boiling component via line 85 can be controlled by valve 51 as described above, i.e., responsive to temperature element 53 and temperature recorder/controller 57.

As shown in FIG. 1, third kettle bottoms collected via line 34 can be further fractionated by passing at least a portion of the third kettle bottoms through line 26 into fourth fractionation column 16, such as for example, a debutanizer column. A fourth overhead fraction is collected via line 46 and a fourth kettle bottom fraction can be collected via line 36. The fourth overhead fraction comprises predominantly high boiling material while the fourth kettle bottom fraction comprises predominantly heavy hydrocarbons or oily materials.

Figure 2:
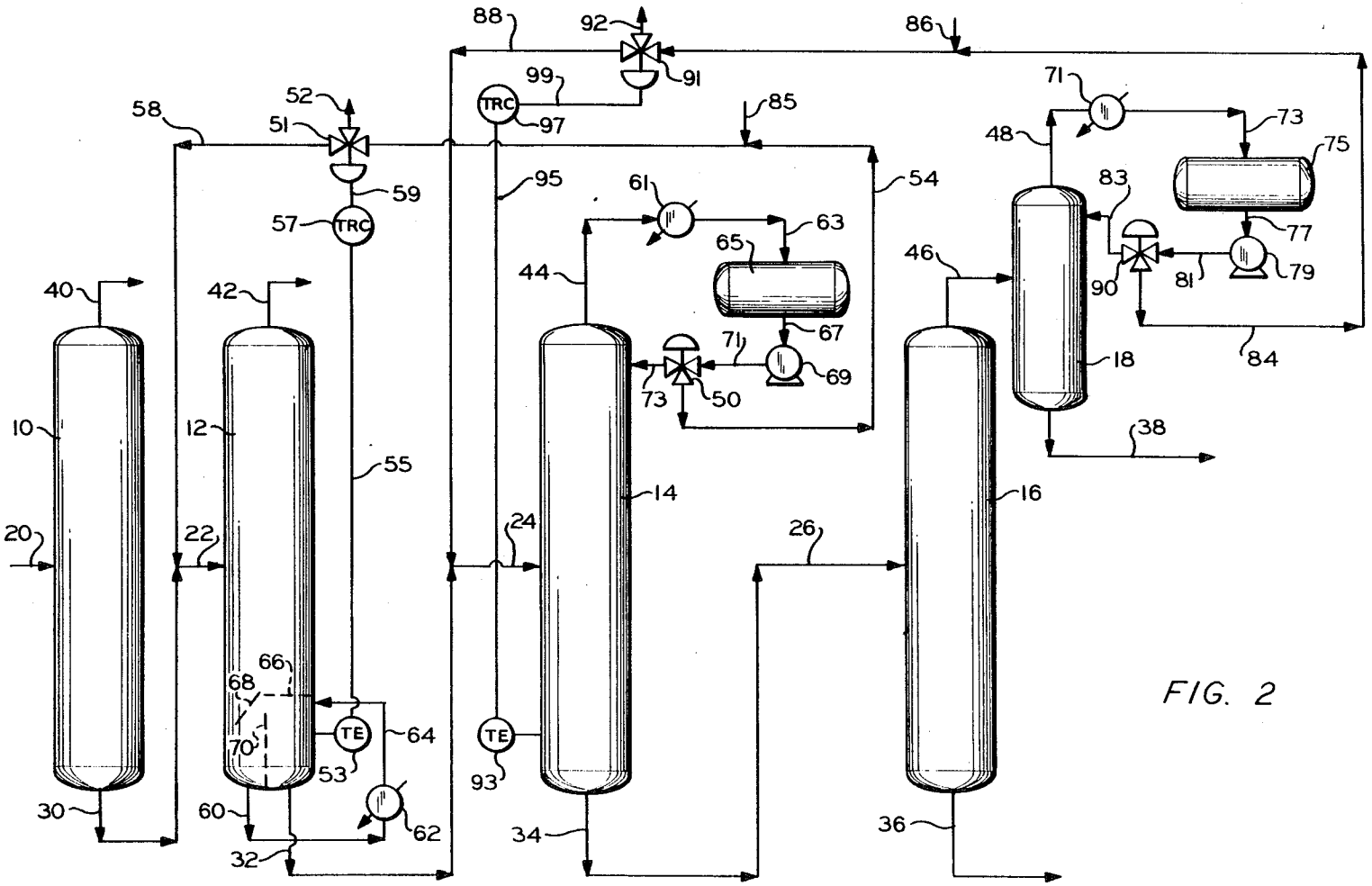
FIG. 2 is a schematic illustration of another embodiment of an apparatus of the invention.

In accordance with another embodiment of the invention, the temperature of the reboiler of column 14 is reduced by providing material with appropriate boiling point via line 24 in addition to the usual feed via line 32. For example, with reference to FIG. 2, the fourth overhead fraction, i.e., high boiling fraction, from column 16 could be recycled from line 46 through lines 84 and 88 to column 14, thereby increasing the content of lower boiling (i.e., non-oily, heavy hydrocarbonaceous) materials in the reboiler kettle for column 14. The temperature of the reboiler kettle for column 14 is thereby reduced by so supplementing the feed stream comprising medium and high boiling components. In an embodiment of the invention wherein ethane thermal cracking unit effluent is being subjected to fractionation, a feed of relatively butadiene-free $C_4$ components can be provided to column 14 via lines 86 and 88 to reduce the temperature of the column 14 reboiler kettle. A relatively butadiene-free $C_4$ feed is preferred because of its relative availability and low propensity for polymerization under fractionation conditions.

In a particularly preferred embodiment, the fourth overhead fraction can be passed to a means for fractionating such as for example column 18 which is capable of separating a relatively butadiene-free $C_4$ stream from the fourth overhead fraction as obtained from line 46. The relatively butadiene-free $C_4$ stream obtained as overhead from column 18 via line 48 is passed through the condensation train comprising condenser 71, conduit 73, accumulator 75, line 77, pump 79, line 81 and 3-way valve 90 in an analogous fashion to that described above with respect to condensation of overhead vapors from column 14. Valve 90 controls the flow of condensate back to column 18 for reflux via line 83 or to product recovery via line 84.

In accordance with this embodiment of the invention, at least a portion of the relatively butadiene-free $C_4$ stream which passes through line 84 can be diverted through 3-way valve 91 via line 88 to column 14 inlet 24. That portion of the relatively butadiene-free $C_4$ stream which is not returned to column 14 can be directed through valve 91 and collected from line 92.

In a preferred mode of this embodiment, the rate of return of relatively butadiene-free $C_4$ stream to the depropanizer column is controlled by direct communication between temperature element 93 and 3-way valve 91. Valve 91 is adjustable in response to the temperature sensed by the temperature sensing means to maintain a preselected temperature at the bottom of column 14. The control means employed is analogous to the control loop described above with respect to recycle of the medium boiling components. An amount of relatively butadiene-free $C_4$ stream is passed via line 24 into column 14 in sufficient quantity to cause a measurable reduction in reboiler temperature.

Product vapors such as obtained from lines 40, 42, 44, 46, 52 and 92 can optionally be further processed as desired or may be collected as obtained for future application.

Similarly, kettle bottom fractions such as obtained from lines 30, 32, 34, 36 and 38 can be used directly for chemical synthesis, blending into fuel or the like. Alternatively, kettle bottom fractions may be subjected to further processing to increase fraction purity or the like. As yet another alternative, kettle bottom fractions may be returned to the cracker in the case of a thermal cracking unit.

Where the feed subjected to the inventive fractionation is the effluent of an ethane thermal cracking unit, approximate operatng conditions of fractionation columns 10, 12, 14 and 16 are as follows:

| Column | Pressure, psig | Temperatures, °F. Top | Kettle |
|---|---|---|---|
| 10 | 415 | −90 | 30 |
| 12 | 280 | 20 | 165–175 |
| 14 | 170 | 100 | 220–230 |
| 16 | 100 | 150 | 240–260 |

Our invention is now further described with respect to the following non-limiting examples.

EXAMPLE I (Control)

In an ethylene plant, feed to the deethanizer column 12 of FIG. 1 was about 400 gals/minute of a principally ethylene-ethane feed with minor amounts of light methane and minor amounts of hydrocarbons heavier than ethane. The temperature of kettle 62 when cracking ethane was about 200°–213° F. The kettle product (line 32) was about 16–18 gals/min of propylene and heavier hydrocarbons. Actual kettle circulation in the thermosyphon type reboiler was about 800 gallons/minute (line 60) to provide the subsequent vapor load required to boil up descending liquid feed components. Pressure was about 260–290 psig. Time between shutdown for cleaning fouled reboiler 62 was about 48 days.

Example II (Invention)

When recycle of about 21 gals/min of depropanizer 14 overhead was begun through valve 50 via line 54 to feed deethanizer 12 operating as described in Example I, the temperature of reboiler 62 was reduced to about 165°–175° F. at about 265 psig. This recycle has been continued at about 21 gals/min and reboiler 62 has not fouled and no shutdown for cleaning has been required in over 11 months of operation.

Example III (Invention)

In the embodiment of the invention wherein butene-1 is recycled to the depropanizer tower (14), the reboiler temperature can be lowered and thus reduce the fouling and increase the length of time on stream before it is necessary to clean the reboiler tubes of fouling deposits. Where the depropanizer tower is operated at about 170 psig with about 16–18 gal/min of feed from the deethanizer, it is calculated that the depropanizer tower kettle temperature will drop from about 245°–250° F. to about 220°–230° F. with about 25–35% recycle of 1-butene in proportion to the other light components of the depropanizer kettle such as cis-and trans-2-butene and 2-methyl propene (isobutene) as well as 1,3 butadiene. With heavier pentane and pyrolysis gasoline present in the kettle of the depropanizer in amounts of about 40–50 wt % and higher, the recycle of added 1-butene or other $C_4$ mono-olefin lowers the boiling temperature of the depropanizer kettle. Currently without recycle of $C_4$ mono-olefins, the average run length before it is necessary to clean the reboiler tubes is about 60 days. It is anticipated that an order of magnitude increase in run length comparable to that observed in Example II compared to control Example I will be obtained. It is desirable not to recycle diolefins such as 1,3 butadiene since diolefins promote fouling in the reboiler. Thus the debutanizer overhead should preferably be treated or separated such as for example by partially hydrogenating, solvent extracting or similar treating to separate mono from diolefins before recycling to the depropanizer.

That which is claimed:

1. A fractionation process comprising:

(a) fractionating in a first fractionating column a first feed stream comprising low, medium and high boiling components; wherein said feed stream contains at least some components which are readily polymerizable at elevated temperature;

(b) recovering said low boiling component as a first overhead and as first kettle bottoms a fraction containing said medium and high boiling components;

(c) fractionating in a second fractionating column said first kettle bottom fraction containing said medium and high boiling components;

(d) recovering said medium boiling component as a second overhead and a fraction containing said high boiling component as second kettle bottoms; and (e) returning at least a portion of the medium boiling component obtained as said second overhead in step (d) to the first feed stream employed in step (a); wherein step (e) is controlled in response to a temperature sensing means positioned at the bottom of said first column.

2. A process according to claim 1 wherein said feed stream is the effluent of an ethane thermal cracking unit.

3. A process according to claim 2 further comprising:

(f) fractionating in a third fractionation column said second kettle bottoms containing said high boiling component; and (g) recovering at least a portion of said high boiling component from step (f) as a third overhead.

4. A process according to claim 3 further comprising:

(h) separating said high boiling component recovered in step (g) to recover a relatively butadiene-free $C_4$ containing fraction; and (i) returning at least a portion of the relatively butadiene-free $C_4$ containing fraction to the feed to the third fractionation column.

5. A process according to claim 4 wherein said feed stream is subjected to a fractionation in a demethanizer column prior to fractionation in said first fractionation column.

6. A process according to claim 1 wherein said low boiling components comprise predominantly C-2 hydrocarbons; said medium boiling components comprise predominantly C-3 hydrocarbons; and said high boiling components comprise predominantly C-4 and higher hydrocarbons.

7. A fractionation process according to claim 1 comprising:

(a) fractionating in a first fractionating column a first feed stream comprising low, medium and high boiling components; wherein said feed stream contains at least some components which are readily polymerizable at elevated temperature;

(b) recovering said low boiling component as a first overhead and as first kettle bottoms a fraction containing said medium and high boiling components;

(c) fractionating in a second fractionating column said first kettle bottom fraction containing said medium and high boiling components;

(d) recovering said medium boiling component as a second overhead and a fraction containing said high boiling component as second kettle bottoms; and (e) returning at least a portion of the medium boiling component obtained as said second overhead in step (d) to the first feed stream employed in step(a);

wherein said first feed stream comprises:

≧90 wt % C-2 hydrocarbons,

≧5 wt % C-3 hydrocarbons, and

≧5 wt % C-4+ hydrocarbons.

8. A process according to claim 1 wherein the boiling range at about 280 psig of said low boiling component is about −10° to about +25° F., said medium boiling component is about 120° to about 140° F., and said high boiling component is about 210° to about 250° F.

9. A process according to claim 1 wherein said feed stream is subjected to fractionation in a demethanizer column prior to fractionation in said first fractionation column.

10. A fractionation process comprising:

(a) fractionating in a first fractionating column a first feed stream comprising low, medium and high boiling components; wherein said feed stream contains at least some components which are readily polymerizable at elevated temperature;

(b) recovering said low boiling component as a first overhead and as first kettle bottoms a fraction containing said medium and high boiling components;

(c) fractionating in a second fractionating column said first kettle bottom fraction containing said medium and high boiling components;

(d) recovering said medium boiling component as a second overhead and a fraction containing said high boiling component as second kettle bottoms; and (e) returning at least a portion of the medium boiling component obtained as said second overhead in step (d) to the first feed stream employed in step (a);

(f) fractionating in a third fractionation column said second kettle bottoms containing said high boiling component;

(g) recovering at least a portion of said high boiling component from step (f) as a third overhead;

(h) separating said high boiling component recovered in step (g) to recover a fraction relatively free of polymerizable components and (i) returning at least a portion of the fraction recovered in step (h) to the feed to the third fractionation column;

wherein step (e) is controlled in response to a temperature sensing means positioned at the bottom of said first column and wherein step (i) is controlled in response to a temperature sensing means positioned at the bottom of said third column.

11. A fractionation process comprising:

(a) fractionating in a first fractionation column a first feed stream comprising medium and high boiling components; wherein said feed stream contains at least some components which are readily polymerizable at elevated temperatures;

(b) recovering said medium boiling component as a first overhead and as first kettle bottoms a fraction containing said high boiling component;

(c) fractionating in a second fractionation column said first kettle bottoms;

(d) recovering said high boiling component as a second overhead and as second kettle bottoms a fraction containing residual materials; and (e) returning at least a portion of said high boiling component to the first feed stream wherein step (e) is controlled in response to a temperature sensing means positioned at the bottom of said first fractionation column.

12. A process according to claim 11, further comprising:

fractionating said high boiling component obtained as a second overhead to remove readily polymerizable materials prior to step (e).

13. A fractionation process comprising:

(a) supplementing the feed stream to a first fractionation column with additional medium boiling component in response to a temperature sensing means positioned at the bottom of said first fractionation column; wherein said feed stream comprises low, medium and high boiling components; and wherein said feed stream contains at least some components which are readily polymerizable at elevated temperatures; thereby producing a supplemented feed stream;

(b) fractionating in a first fractionation column said supplemented feed stream;

(c) recovering said low boiling component as a first overhead and as first kettle bottoms a fraction containing said medium and high boiling components;

(d) fractionating in a second fractionating column said first kettle bottom fraction containing said medium and high boiling component; and (e) recovering said medium boiling component as a second overhead and a fraction containing said high boiling component as second kettle bottoms.

14. A fractionation process comprising:

(a) supplementing the feed stream to a first fractionation column with additional high boiling component in response to a temperature sensing means positioned at the bottom of said first fractionation column wherein said feed stream comprises medium and high boiling components; and wherein said feed stream contains at least some components which are readily polymerizable at elevated temperatures thereby producing a supplemented feed stream;

(b) fractionating in a first fractionation column said supplemented feed stream;

(c) recovering said medium boiling component as a first overhead and as first kettle bottoms a fraction containing said high boiling componen;

(d) fractionating in a second fractionation column said first kettle bottom; and (e) recovering said high boiling component as a second overhead and as second kettle bottoms a fraction containing residual materials.

15. Apparatus comprising:

a deethanizer column with inlet means, outlet means for removal of material overhead and outlet means for removal of column bottoms;

a depropanizer column with inlet means, outlet means for removal of material overhead and outlet means for removal of column bottoms;

a first conduit in open communication with the outlet means for removal of column bottoms from said deethanizer column and the inlet means of said depropanizer column;

a second conduit in open communication with the outlet means for removal of material overhead from said depropanizer column and the inlet means of said deethanizer column;

valve means on said second conduit; and temperature sensing means at the bottom of the deethanizer column;

wherein said valve means is in communication with said temperature sensing means; and wherein said valve means is adjustable in response to the temperature sensed by said temperature sensing means to maintain a preselected temperature at the bottom of said deethanizer.

16. Apparatus as described in claim 15 further comprising:

a demethanizer column with inlet means, outlet means for removal of material overhead and outlet means for removal of column bottoms;

a fifth conduit in open communication with the outlet means for removal of columm bottoms from said demethanizer column and the inlet means of said deethanizer column.

17. Apparatus as described in claim 16 further comprising:

a debutanizer column with inlet means, outlet means for removal of material overhead and outlet means for removal of column bottoms;

a sixth conduit in open communication with the outlet means for removal of column bottoms from said depropanizer column and the inlet means for said debutanizer column.

18. Apparatus as described in claim 15 further comprising:

a debutanizer column with inlet means, outlet means for removal of material overhead and outlet means for removal of column bottoms;

a sixth conduit is open communication with the outlet means for removal of column bottoms from said depropanizer column and the inlet means for said debutanizer column.

19. Apparatus comprising:

a deethanizer column with inlet means, outlet means for removal of material overhead and outlet means for removal of column bottoms;

a depropanizer column with inlet means, outlet means for removal of material overhead and outlet means for removal of column bottoms;

a first conduit in open communication with the outlet means for removal of column bottoms from said deethanizer column and the inlet means of said depropanizer column;

a second conduit in open communication with the outlet means for removal of material overhead from said depropanizer column and the inlet means of said deethanizer column;

a demethanizer column with inlet means, outlet means, for removal of material overhead and outlet means for removal of column bottoms;

a fifth conduit in open communication with the outlet means for removal of column bottoms from said demethanizer column and the inlet means of said deethanizer column;

a debutanizer column with inlet means, outlet means for removal of material overhead and outlet means for removal of column bottoms;

a sixth conduit in open communication with the outlet means for removal of columm bottoms from said depropanizer column and the inlet means from said debutanizer column;

a means for fractionating the overhead fraction from the debutanizer column to give a relatively butadiene-free $C_4$ fraction wherein said means for fractionating is equipped with an inlet and an outlet means;

a third conduit in open communication with the outlet means for removal of material overhead from said debutanizer column and the inlet means of said means for fractionating the overhead fraction from the debutanizer column; the inlet means of said means for fractionating the overhead fraction from the debutanizer column;

a first valve means on said second conduit;

a second valve means on said fourth conduit;

a first temperature sensing means at the bottom of the deethanizer column; and a second temperature sensing means at the bottom of the depropanizer column; wherein said first valve means is in communication with said first temperature sensing means and said second valve means is in communication with said second temperature sensing means; and wherein said first valve means is adjustable in response to the temperature sensed by said first temperature sensing means to maintain a preselected temperature at the bottom of said deethanizer and said second valve means is adjustable in response to the temperature sensed by said second temperature sensing means to maintain a preselected temperature at the bottom of said depropanizer.

20. Apparatus comprising:

a depropanizer column with inlet means, outlet means for the removal of material overhead and outlet means for removal of column bottoms;

a debutanizer column with inlet means, outlet means for the removal of material overhead and outlet means for removal of column bottoms;

a means for fractionating the overhead fraction from the debutanizer column to give a relatively butadiene-free $C_4$ fraction wherein said means for fractionating is equipped with an inlet and an outlet means;

a first conduit in open communication with the outlet means for removal of column bottoms from said depropanizer column and inlet means of said debutanizer column;

a second conduit in open communication with the outlet means for removal of material overhead from said debutanizer column and the inlet means of said means for fractionating the overhead fraction from the debutanizer column;

a third conduit in open communication with the outlet means of said means for fractionating and said inlet means for said depropanizer column;

valve means on said third circuit;

and temperature sensing means at the bottom of the depropanizer column;

wherein said valve means is in communication with said temperature sensing means; and wherein said valve means is adjustable in response to the temperature sensed by said temperature sensing means to maintain a preselected temperature at the bottom of said depropanizer.

* * * * *